US005638937A

United States Patent [19]

Birney et al.

[11] Patent Number: 5,638,937

[45] Date of Patent: Jun. 17, 1997

[54] HANDRAIL DRIVE SYSTEM CONVERSION

[75] Inventors: Lawrence V. Birney, Swanton, Ohio; Thomas A. Keller, Petersburg; William I. Thompson, Brooklyn, both of Mich.; Dean L. Jodry, Sylvania, Ohio; Richard A. Stewart, Temperance, Mich.

[73] Assignee: Inventio AG, Hergiswil NW, Switzerland

[21] Appl. No.: 608,956

[22] Filed: Feb. 29, 1996

Related U.S. Application Data

[63] Continuation of Ser. No. 372,376, Jan. 13, 1995, abandoned.

[51] Int. Cl.[6] ..... B66B 23/24

[52] U.S. Cl. ..... 198/335

[58] Field of Search ..... 198/331, 335, 198/336

[56] References Cited

U.S. PATENT DOCUMENTS

| | | |
|---|---|---|
| Re. 25,531 | 3/1964 | Fabula . |
| 2,039,994 | 5/1936 | Herker . |
| 2,885,057 | 5/1959 | Hansen . |
| 2,929,483 | 3/1960 | Jin . |

(List continued on next page.)

FOREIGN PATENT DOCUMENTS

| | | | |
|---|---|---|---|
| 265119 | 12/1967 | Austria . | |
| 898177 | 4/1972 | Canada . | |
| 898178 | 4/1972 | Canada . | |
| 556502 | 7/1923 | France . | |
| 1484075 | 6/1967 | France . | |
| 1506480 | 10/1969 | Germany . | |
| 2752671 | 6/1978 | Germany . | |
| 0036882 | 4/1978 | Japan | 198/336 |
| 54-25076 | 2/1979 | Japan . | |
| 2-193886 | 7/1990 | Japan . | |
| 3-102093 | 4/1991 | Japan . | |
| 3-79591 | 4/1991 | Japan . | |
| 5-58688 | 4/1993 | Japan . | |
| 165990 | 6/1970 | Netherlands . | |
| 449886 | 4/1968 | Switzerland . | |
| 485588 | 3/1970 | Switzerland . | |
| 751773 | 7/1980 | U.S.S.R. . | |
| 779236 | 11/1980 | U.S.S.R. . | |
| 963924 | 2/1983 | U.S.S.R. . | |
| 1402513 | 6/1988 | U.S.S.R. . | |
| 1557050 | 4/1990 | U.S.S.R. . | |
| 1557051 | 4/1990 | U.S.S.R. . | |
| 731131 | 6/1955 | United Kingdom . | |
| 918176 | 2/1963 | United Kingdom . | |
| 1112718 | 5/1968 | United Kingdom | 198/336 |

OTHER PUBLICATIONS

General Elevator submission, including one–page letter dated Mar. 13, 1991, one–page Proposal and Acceptance dated Mar. 13, 1991, including one–page Attachment A and one–page drawing of escalator.

General Elevator submission, including two–page letter dated Aug. 11, 1992, one–page Attachement A and one–page drawing of escalator entitled "Design Concept for New Handrail Drive DWG": Marta – 1992.

(List continued on next page.)

*Primary Examiner*—D. Glenn Dayoan

*Attorney, Agent, or Firm*—Greenblum & Bernstein P.L.C.

[57] ABSTRACT

In a factory prefabricated drive system conversion unit for the handrail of an existing escalator, the drive system conversion unit includes a channel member adapted to be fixedly connected to an existing escalator structure, with a rotatable friction wheel being mounted between the channels and driven via a chain drive, having a plurality of pressing rollers, and a lever-operated tensioning device, with a set of cluster rollers, having a plurality of rollers, being mounted on a cluster roller base plate arranged on each side of the friction wheel, and also including a handrail turn around with a clamped roller chain having a plurality of both roller and chain links, as well as end pieces and intermediate guide members. Directionless cluster roller bases as well as directionless channels can also be utilized to simplify and speed up the conversion operation.

10 Claims, 2 Drawing Sheets

U.S. PATENT DOCUMENTS

| | | | |
|---|---|---|---|
| 3,094,213 | 6/1963 | Fabula | 198/336 |
| 3,170,557 | 2/1965 | Takenaga et al. . | |
| 3,321,060 | 5/1967 | Mullis etal. . | |
| 3,414,108 | 12/1968 | Jackson et al. . | |
| 3,595,364 | 7/1971 | Schoneweiss | 198/335 |
| 3,623,589 | 11/1971 | Johnson | 198/335 |
| 3,651,919 | 3/1972 | Vollmer . | |
| 3,666,075 | 5/1972 | Iwata . | |
| 3,696,909 | 10/1972 | Kojima et al. | 198/331 |
| 3,749,224 | 7/1973 | Engeler . | |
| 3,779,360 | 12/1973 | El Taher et al. . | |
| 4,134,883 | 1/1979 | Mendelsohn et al. . | |
| 4,227,605 | 10/1980 | Hofling | 198/331 |
| 4,258,543 | 3/1981 | Canevari et al. . | |
| 4,535,880 | 8/1985 | Boltrek . | |
| 4,564,099 | 1/1986 | Uozumi . | |
| 4,580,675 | 4/1986 | Boltrek . | |
| 4,589,539 | 5/1986 | Boltrek . | |
| 4,674,619 | 6/1987 | Nakazawa et al. . | |
| 4,776,446 | 10/1988 | Fisher et al. . | |
| 4,875,568 | 10/1989 | Hermann et al. . | |
| 4,895,240 | 1/1990 | Bruehl et al. . | |
| 5,072,820 | 12/1991 | Steffen et al. . | |
| 5,117,960 | 6/1992 | Ahls et al. . | |
| 5,125,494 | 6/1992 | Nurnberg et al. . | |
| 5,188,209 | 2/1993 | Johnson et al. | 198/336 |
| 5,207,308 | 5/1993 | Sheffield et al. . | |
| 5,255,772 | 10/1993 | Ball et al. . | |
| 5,295,567 | 3/1994 | Zaharia et al. . | |
| 5,307,920 | 5/1994 | Meyer et al. . | |
| 5,372,232 | 12/1994 | Ahls et al. . | |
| 5,427,221 | 6/1995 | Spriggs et al. | 198/335 |

OTHER PUBLICATIONS

Schindler Elevator Corporation Technical Services Bulletin, dated Oct. 1, 1987, including drawing of escalator entitled "Location of Handrail Roller Drive Assembly".

Schindler Elevator Corporation document entitled "Retrofit Handrail Tension Device, HA–990–C7, Replacement for Pressure Type Belt" dated May 1987.

Millar Elevator Service Co. one–page sketch entitled "HR. conversion Drive for Mod B", dated Jul. 31, 1992.

"Overview of Escalator Applications in Rail Transit", U.S. Department of Transportation, Jul. 1, 1980.

Photograph of handrail drive conversion unit being marketed by the firm John P. Spriggs, Home Elevators Inc., Roswell, George, U.S.A. (No Date).

HANDRAIL DRIVE SYSTEM CONVERSION

This application is a continuation of application Ser. No. 08/372,376, filed Jan. 13, 1995, now abandoned.

BACKGROUND OF THE INVENTION

1. Field of the Invention

The subject invention pertains to a factory or offsite prefabricated drive conversion unit for the technical renovation of an existing escalator, with which, during the local modification work, the old handrail drive and its peripheral parts are replaced without changing the existing basic structure of the escalator.

2. Discussion of the Background of the Invention and Material Information

The handrail drive of an escalator is a technically demanding assembly. Its main task or object consists of the gentle guiding and tensioning as well as synchronous driving, relative to the stair movement, of the handrail. For the care of the handrail as well as for achieving the longest possible service life, the frictional forces, specifically produced by the drive unit, should not be excessive due to the danger of crushing or deformation, and the bending or deflection angles, due to the accompanying overload of the handrail edges, should not be too tight or narrow. In addition, the operation thereof should occur with the use of small tension forces, which in turn increases the degree of effectiveness of the drive and which contributes to the care or protection of the entire system. Old, existing handrail drive systems generally cannot meet the noted requirements and show, even after a relatively short service time, corresponding wear patterns. With an otherwise generally good operating condition of an escalator, it is therefore worthwhile to replace the handrail drive unit with a conversion or exchange construction which, at the same time, permits the upgrading thereof to new standards and requirements.

Generally, two different drive methods or principles are utilized, one pertaining to the pressing of the handrail, with a partial envelopment, onto a large friction wheel, the other pertaining to the passage of the handrail through a plurality of linearly arranged friction and control roller pairs which also frictionally drive the handrail.

The first-noted principle permits that, in addition to the handrail drive, the clamping device can be arranged within the same arrangement, which makes the addition of a second peripherally placed tensioning assembly superfluous.

U.S. Pat. No. 3,651,919 to Vollmer describes and shows a handrail drive of the previously noted type. The lower part of the escalator utilizes a friction wheel which is enveloped by the handrail over an angle of about 90° and is pressed thereagainst by a tensioned roller chain. Located on each side of the driving wheel, in order to maintain the angle of envelopment, are fixedly attached turn around or return elements, each utilizing three rollers. An additional device, arranged at the upper portion of the escalator, is utilized for the tensioning of the handrail.

The turn around elements of this device bend the handrail strongly backwards and the separate tensioning device additionally adds to the cost of the drive. It is obvious that this handrail drive can be improved via an exchange or conversion unit which utilizes the advantages of a modern, technical drive.

The firm of John P. SPRIGGS, Home Elevators Inc., Roswell, Ga., U.S.A., is marketing a handrail drive exchange or conversion unit, U.S. Pat. No. 5,427,221, which includes, in a common carrier unit, a friction wheel with a pressing device having turn around and guide rollers on both sides thereof. Therein, the handrail, both before and after the pressing device, runs over but a single roller, so that the handrail suffers from high wear due to the severe deviation thereof. In addition, the outer guidance causes frictional markings or grooves in the turn around rollers.

SUMMARY OF THE INVENTION

It is therefore the task or object of this invention to produce a conversion or exchange handrail drive which avoids the previously noted disadvantages; can be utilized without requiring changes in the existing basic structure; and which drives and guides the handrail without slip and with the greatest possible care.

This task or object is achieved by the subject invention via the features set forth in the appended claims.

Specifically, in this invention, in a factory prefabricated drive system conversion unit for the handrail of an existing escalator, the drive system conversion unit includes a channel member adapted to be fixedly mechanically connected to an existing escalator structure; a rotatable friction wheel mounted between the channels and driven via a chain drive; a roller chain, having a plurality of pressing rollers, and a lever-operated tensioning device; a set of cluster rollers, having a plurality of rollers, mounted on a cluster roller base plate arranged on each side of the friction wheel; and a handrail turn around, secured at each end of the existing escalator structure, including a clamped roller chain having a plurality of both roller and chain links, as well as end pieces and intermediate guide members.

In a further embodiment of the drive system conversion unit of this invention, the set of cluster rollers, mounted on each side of the friction wheel, are pivotable about a pivot axis and affixable via retention screws passing through elongated apertures in the cluster roll base plates, and the pivot axis is coincident with the axis of a cluster roll, of the plurality of cluster rollers, most closely adjacent to the axis of the friction wheel.

In another embodiment of the drive system conversion unit of this invention, the set of cluster rollers, mounted on each side of the friction wheel, is each retained by means of a threaded stud, adjusting nuts, and an angle support plate.

In an additional embodiment of the drive system conversion unit of this invention, the plurality of the rollers of the set of cluster rollers, mounted on each side of the friction wheel, is arranged along a curved path, whose radius is one of the same and larger than the radius of the friction wheel.

In still a further embodiment of the drive system conversion unit of this invention, the plurality of the rollers of the set of cluster rollers, mounted on each side of the friction wheel, further include horizontal stud-mounted guide rollers, rotatably retained on a guide support for the lateral guidance of the handrail.

A yet another embodiment of this invention pertains to factory prefabricated conversion drive unit for the technical upgrading of an already existing escalator via which, in an on-site conversion step, the existing old handrail drive unit and its peripheral parts are replaced without changing the basic existing structure of the escalator, the conversion drive unit including a directionless cluster roller base, via the use of which left hand as well as right hand cluster roller sets are produced.

A still an additional embodiment of this invention pertains to a factory prefabricated conversion drive unit for the technical upgrading of an existing escalator via which, in an on-site conversion step, the existing old handrail drive unit and its peripheral parts are replaced without changing the basic existing structure of the escalator, the conversion drive unit including a channel member wherein the channel member is provided with all of the apertures, recesses and attachment points which are necessary for the assembly of both left hand and right hand drive conversion units.

The advantages of the present invention are that the entire prefabricated conversion or exchange unit can be installed without costly adaptive work; that the handrail drive occurs with the highest possible care; and that, at the same time, conformity with existing standards and requirements can be achieved.

Additional advantages reside in the fact that the latest developments, regarding materials technology and construction technology, are utilized.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
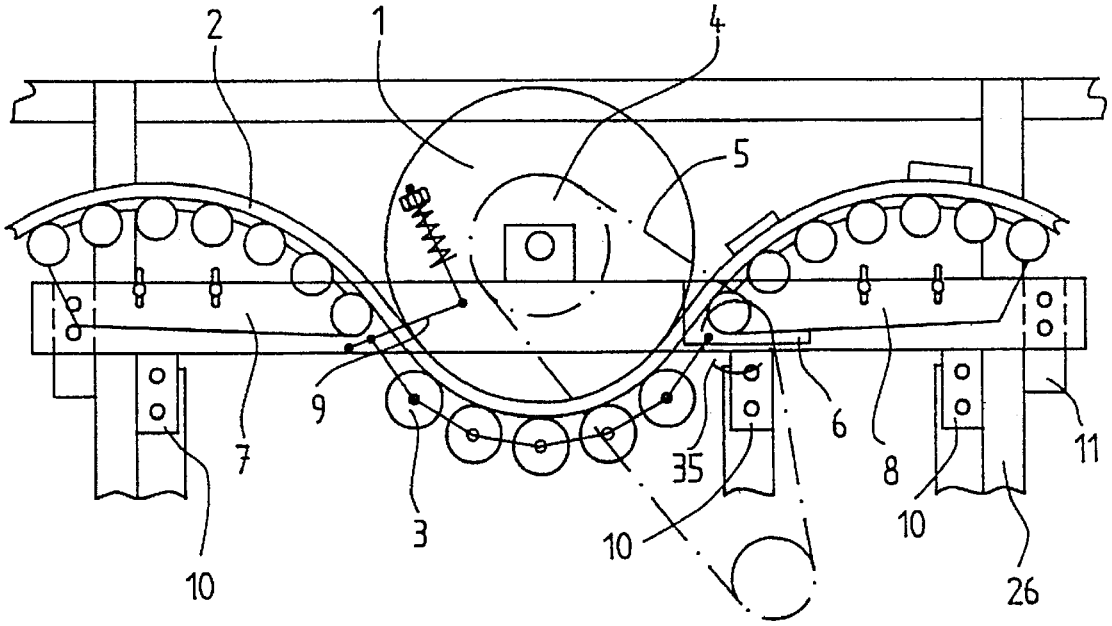
FIG. 1 is an overall view of the drive system conversion unit.

In FIG. 1, numeral 1 denominates a friction wheel which is enveloped over about 90° by a handrail 2 and pressed thereagainst by means of a tensioned roller chain 3. Friction wheel 1 is driven by a chain drive 5 via a coaxially affixed sprocket 4. Roller chain 3 is retained in constant mechanical tension, at a predetermined tension, via a tensioning device 9 comprised of a ratio lever, threaded set bolt, clamping nuts and a spring.

Arranged on each side of friction wheel 1 is a left hand and right hand set 7, 8, respectively, of cluster rollers 16, arranged along a curved line, over which handrail 2 is received or guided as it leaves friction wheel 1. Friction wheel 1 and roller group sets 7, 8, as well as the mounting support for roller chain 3 and its tensioning device 9, are all mounted on a common channel member 6, with channel member 6 in turn being connected with the existing structure of the escalator via adaptor portions 10 and a support bracket 11.

Figure 2:
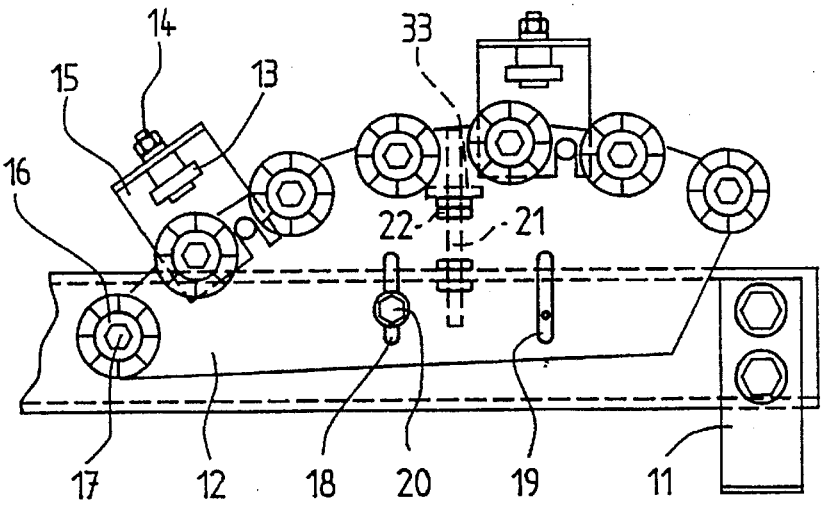
FIG. 2 is an overall view of a left hand cluster roller set.

FIG. 2 shows the details of right hand cluster roller set 8. Mounted on the upper periphery of a cluster roller base or plate 12, in short, uniform spacings, are seven rollers 16, arranged along a curved line. The entire cluster roller set 8 can be pivoted about a pivot point 17 coincident with the axis of the left-most first roller 16, with this pivoting being bounded within the region of the elongated holes 18 and 19 that are located at about the center of cluster roller base 12. Retention screws 20, affixed to channel member 6 and extending through elongated holes 18 and 19, block or retain cluster roller base 12 in an adjusted position. As a set-up or adjustment aid, a threaded stud 21, threaded in channel member 6 and provided with adjusting nuts 22, is provided on the back side of cluster roll base plate 12 and extends parallel to elongated holes 18 and 19. Cluster roller base plate 12 is additionally braced or retained on adjusting nuts 22, above threaded stud 21, via an angle support 33 welded on the rear face or side of plate 12 and can, upon the loosening of retention screws 20, be adjusted to a specific height position.

Horizontal guide rollers 13, each affixed on a stud 14 of guide support 15, are provided between the second and third as well as the fourth and fifth rollers 16. Guide rollers 13, in the form of a rolling element bearing such as a ball bearing, are enclosed by the profile of handrail 2 and thereby provide the side or lateral guidance thereof solely via rolling friction.

Figure 3:
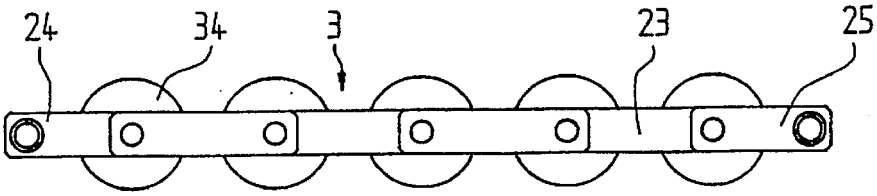
FIG. 3 shows the contact pressure roller chain.

Roller chain 3, shown in FIG. 3, is comprised of chain members or links 23 and rollers 34, with left and right end members or links being denominated by numerals 24 and 25, respectively.

Figure 4:
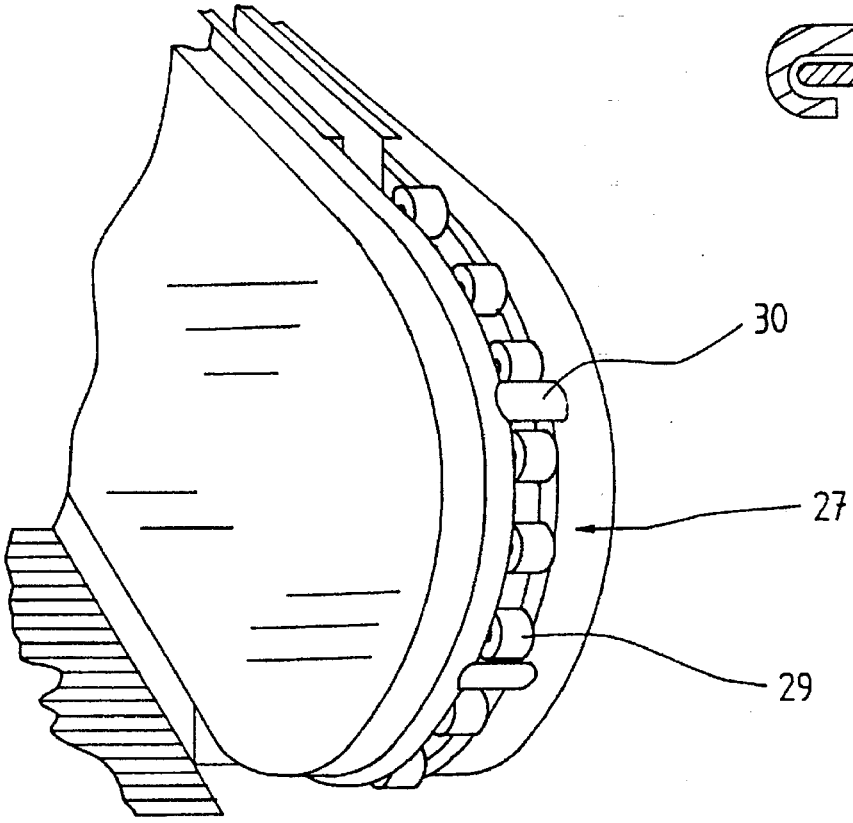
FIG. 4 shows the handrail turn around.
Figure 6:
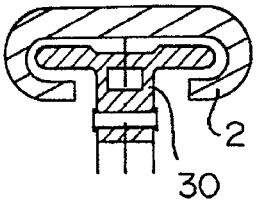
FIG. 6 shows a guide member of the handrail turn around.

FIG. 4 shows the turn around 27 of handrail 2 at a stair or escalator end.

Figure 5:
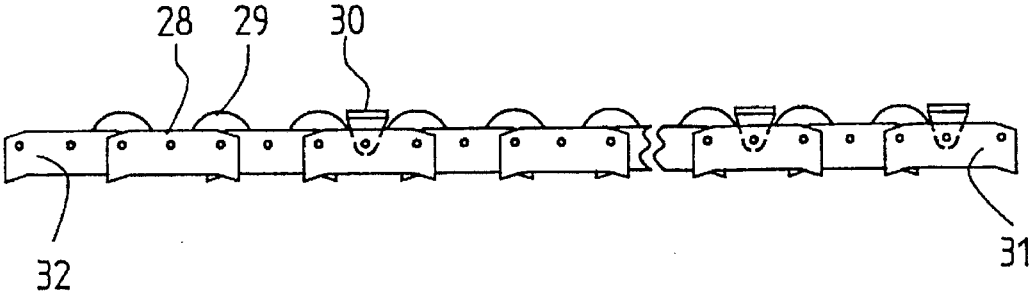
FIG. 5 shows the roller chain of the handrail turn around.

FIG. 5 illustrates the individual parts of turn around or return 27, which takes the form of a roller chain having chain links 28, rollers 29, end pieces or terminal ends 31 and 32 as well as guide members 30, the latter being inserted and clamped into the U-shaped, semicircularly extending canals or channels of the balustrade constructions at the stair or escalator ends. Freely rotatable rollers 29 permit a low friction turn around of handrail 2, with guide members 30 serving for the lateral guiding of handrail 2.

The function of the entire apparatus should, in principle, be evident from the drawing figures. A special feature is the gentle guidance of the handrail as it exits from the friction wheel 1. Rollers 16 are arranged along a circular path which, in comparison to friction wheel 1, has the same or a larger radius, wherein friction wheel 1 already has, considering the space available, the largest possible radius. In order to best possibly avoid the excessive bending or contortion of handrail 2, upon the resetting of the handrail tension, not the entire cluster roller sets 7 and 8 are adjusted, in parallel, height-wise, but are rather pivoted upwardly about pivot axis 18, only as far as is necessary to obtain the desired tension, and are then again fixedly secured. This tension generally should not be high and any resetting thereof should only avoid excessive slack during the return of handrail 2. The length of handrail 2 is so measured that in the new condition, rail 2 does not yet touch the last roller 16 of left hand cluster roller set 7 and/or right hand cluster roller set 8. Such touching occurs only after the first or second resetting or adjustment thereof. As soon as, after several adjustments, there is a bending or contortion as handrail 2 emanates from one of cluster roller sets 7 or 8, wherein the radius of the bend is smaller than that of the roll curvature, then the handrail length must be shortened.

The adjustment of one of cluster roller sets 7 or 8 is eased in that cluster roller sets 7 or 8, upon the loosening of retention screws 20, have their angle support 33 resting upon adjusting nuts 22 of threaded stud 21 and thus do not suddenly slide vertically downward. Any further adjustment can then be made by merely upwardly turning adjusting screws 22 and then successively tightening retention screws 20 in elongated or slotted holes or apertures 18 and 19. FIG. 1 illustrates the extreme upper settings of cluster roller sets 7 and 8. The thin or dotted lines additionally show the extreme lower settings.

The drive of handrail 2, only via friction, requires a relatively high pressing force thereof onto friction wheel 1. Therefore, the tension of roller chain 3 must be set very high and maintained for pressing rollers 34. For this purpose, roller chain 3 has its right terminal piece attached to channel member 6 and its left terminal piece 24 guided or retained by a lever tensioning device 9. Since the tensioning device lever ratio is, for example, 5:1, the right lever end can, via the use of the threaded rod, compression spring and nut, be adjusted with very little effort so as to produce a sufficiently large tensioning force.

The construction of the device or apparatus of this invention is furthermore so designed that the installation is both short and problem free. This requires a construction which requires no adaptation work relative to existing structure 26. Adapter members 10 and a support bracket 11 serve as intermediate members. By means of these intermediate members the installation of the conversion or replacement drive is made possible without requiring changes at the existing structure of differing types of escalators. Even in a worst case situation only additional intermediate members need be utilized and even these can be prefabricated, thus necessitating no increased time requirements for the rebuilding of the escalator. In order to achieve the highest possible universal utilization of the conversion drive system, channel member or plate 6 is provided with several additional apertures in order to avoid drilling at the construction site. Thus it is possible, even with the use of simple clamping brackets to achieve a solid or rigid attachment of the conversion drive system at an existing structure 26.

The drive or actuation of this device is accomplished by means of a sprocket 36 mounted on an existing drive shaft via a chain drive 5 having a chain tensioning roller 35. The transmission via chain drive 5 allows, upon the consideration of minimal of slip in the handrail drive, the highest possible synchronization with the movement of the steps. Long and trouble-free operation of the conversion drive system is assured in that all rotating bearings take the form of sealed rolling element bearings.

In a further embodiment of the conversion drive system and of channel 6, the latter can be so designed that a single design or embodiment can be utilized for both left and right hand sides of the escalator. Therefore, a neutral-sided or direction-less channel contains all of the holes, recesses and attachment points so as to permit, via an offsite or factory preassembly, the production of a conversion drive system for the use in both left and right hand side applications. Thus, the drive systems or assemblies for the left and right hand sides of the escalator are identical in design but of allochiral or mirror image construction.

In addition, cluster roller base or plate 12 can be so constructed that with but a single design variation, both left and right hand cluster roller sets 7 and 8, respectively, can be produced. In this design, angle support 33 is no longer welded onto the rear face or side of plate 12, but rather the horizontal leg portion thereof is slid through a stamped slot, with the vertical leg portion being attached, via screws that extend through pre-stamped apertures, at preassembly. Prefabricated cluster roller bases of this type, since they are thus no longer bulky, can be stored more compactly and at double density, as well as being easier to manufacture.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A factory prefabricated drive system conversion unit for the handrail of an existing escalator, the drive conversion unit comprising:

a channel member adapted to be fixedly mechanically connected to an existing escalator structure;

a rotatable friction wheel mounted on the channel member and driven via a chain drive;

a roller chain, having a plurality of pressing rollers, and a lever-operated tensioning device;

a set of cluster rollers, having a plurality of rollers, mounted on a cluster roller base plate arranged on each side of the friction wheel, wherein the set of cluster rollers are pivotable about a pivot axis and affixable via retention screws passing through elongated apertures in the cluster roll base plates, wherein the pivot axis is coincident with the axis of a cluster roll, of the plurality of cluster rollers, most closely adjacent to the axis of the friction wheel; and a handrail turn around secured at each end of the existing escalator, the handrail turn around including a clamped roller chain having a plurality of both roller and chain links, as well as end pieces and intermediate guide members.

2. The drive system conversion unit of claim 1, wherein the set of cluster rollers, mounted on each side of the friction wheel, is each retained by means of a threaded stud, adjusting nuts, and an angle support plate.

3. The drive system conversion unit of claim 1 wherein the plurality of the rollers of the set of cluster rollers, mounted on each side of the friction wheel, is arranged along a curved path, whose radius is one of the same and larger than the radius of the friction wheel.

4. The drive system conversion unit of claim 2, wherein the plurality of the rollers of the set of cluster rollers, mounted on each side of the friction wheel, is arranged along a curved path, whose radius is one of the same and larger than the radius of the friction wheel.

5. The drive system conversion unit of claim 1, wherein the plurality of the rollers of the set of cluster rollers, mounted on each side of the friction wheel, further include horizontal stud-mounted guide rollers, rotatably retained on a guide support for the lateral guidance of the handrail.

6. The drive system conversion unit of claim 2, wherein the plurality of the rollers of the set of cluster rollers, mounted on each side of the friction wheel, further include horizontal stud-mounted guide rollers, rotatably retained on a guide support for the lateral guidance of the handrail.

7. The drive system conversion unit of claim 3, wherein the plurality of the rollers of the set of cluster rollers, mounted on each side of the friction wheel, further include horizontal stud-mounted guide rollers, rotatably retained on a guide support for the lateral guidance of the handrail.

8. A factory prefabricated drive system conversion unit for the handrail of an existing escalator, the drive conversion unit comprising:

a channel member adapted to be fixedly mechanically connected to an existing escalator structure;

a rotatable friction wheel mounted on the channel member and driven via a chain drive;

a roller chain, having a plurality of pressing rollers, and a lever-operated tensioning device;

a set of cluster rollers, having a plurality of rollers, mounted on a cluster roller base plate arranged on each side of the friction wheel, said plurality of rollers include horizontal stud-mounted guide rollers, rotatably retained on a guide support for the lateral guidance of the handrail, wherein the set of cluster rollers are pivotable about a pivot axis and affixable via retention screws passing through elongated apertures in the cluster roll base plates; and a handrail turn around secured at each end of the existing escalator, the handrail turn around including a clamped roller chain having a plurality of both roller and chain links, as well as end pieces and intermediate guide members.

9. The drive system conversion unit of claim 8, wherein the set of cluster rollers, mounted on each side of the friction wheel, is each retained by means of a threaded stud, adjusting nuts, and an angle support plate.

10. The drive system conversion unit of claim 8, wherein the plurality of the rollers of the set of cluster rollers, mounted on each side of the friction wheel, is arranged along a curved path, whose radius is one of the same and larger than the radius of the friction wheel.

* * * * *